US008388215B2

(12) United States Patent
Kay et al.

(10) Patent No.: US 8,388,215 B2
(45) Date of Patent: Mar. 5, 2013

(54) ASPHALT REACTOR AND BLENDING SYSTEM

(75) Inventors: John Kay, Scottsdale, AZ (US); Kelly Sockwell, Scottsdale, AZ (US)

(73) Assignee: Stratco, Inc., Scottsdale, AZ (US)

( * ) Notice: Subject to any disclaimer, the term of this patent is extended or adjusted under 35 U.S.C. 154(b) by 1141 days.

(21) Appl. No.: 12/067,603

(22) PCT Filed: Sep. 21, 2006

(86) PCT No.: PCT/US2006/036822

§ 371 (c)(1), (2), (4) Date: Jul. 24, 2008

(87) PCT Pub. No.: WO2007/035868

PCT Pub. Date: Mar. 29, 2007

(65) Prior Publication Data

US 2008/0298160 A1 Dec. 4, 2008

Related U.S. Application Data

(60) Provisional application No. 60/719,000, filed on Sep. 21, 2005.

(51) Int. Cl.
*B28C 5/46* (2006.01)

(52) U.S. Cl. ..... 366/23; 366/65; 366/149; 366/198

(58) Field of Classification Search ..... 366/23, 366/24, 149, 153.1, 157.3, 157.4, 198, 204, 366/205, 246, 264, 270, 65
See application file for complete search history.

(56) References Cited

U.S. PATENT DOCUMENTS

| | | | | |
|---|---|---|---|---|
| 2,206,266 | A * | 7/1940 | Schmidt | 366/264 |
| 2006/0016760 | A1 * | 1/2006 | Bozak et al. | 210/708 |
| 2006/0221763 | A1 * | 10/2006 | Reis et al. | 366/149 |
| 2009/0188299 | A1 * | 7/2009 | Komura et al. | 73/23.41 |

* cited by examiner

*Primary Examiner* — Yogendra Gupta
*Assistant Examiner* — Robert J Grun
(74) *Attorney, Agent, or Firm* — Booth Udall Fuller, PLC

(57) ABSTRACT

A modified asphalt Contactor reactor for blending and reacting asphalt cement and modifiers is described; for example, a vertically oriented vessel having an outer shell having an internal surface and an external surface, a lower end and a flat flanged top; an internal circulation tube having a base, a top and an outside surface, wherein the outside surface of the internal circulation tube and the internal surface of the outer shell forms an annulus; a heating jacket having heating oil inlet and a heating oil outlet coupled to the external surface of the outer shell for circulation of heating oil; and a hydraulic head assembly having an impeller coupled to the lower end the vertically oriented vessel wherein the impeller is located near the base of the internal circulation tube, wherein the impeller and the annulus are of sufficient size to facilitate the flow of high viscosity fluids.

11 Claims, 3 Drawing Sheets

ASPHALT REACTOR AND BLENDING SYSTEM

FIELD OF THE INVENTION

This invention is related to asphalt reactors and blending systems and especially asphalt reactors and blending systems used for blending and reacting modified asphalt cement. The modifiers (also sometimes called or considered to be fillers) can exist in many forms including, but not limited to, crumb rubber, styrene butadiene styrene (SBS) block copolymers, styrene butadiene rubber (SBR) polymer, low density polyethylene (LDPE), calcium carbonate, ethylene acrylate copolymer (Elvaloy®), etc.

BACKGROUND

Although certain asphalt rubber blending systems have been in use for a number of years, existing systems utilize a separate blender, which discharges into a reaction tank that is mildly agitated and heated. Basic vertical reactors have been used successfully in manufacturing lubricating greases, soaps, lotions and other emulsions but are unsuitable for application to modified asphalts without modification.

SUMMARY

One aspect of the invention comprises a reactor design as a vessel that is vertically oriented with a bottom-mounted axial flow impeller. The vessel is equipped with an internal cylindrical circulation tube with the impeller located at the lower end. The impeller pulls the vessel contents downward through the core of the circulation tube, discharging into the hydraulic head, which is designed to smoothly channel the flow upward through the annulus between the vessel outer shell and the outside surface of the circulation tube. The flow travels upward and over the top of the circulation tube, returning downward into the core to complete its circuit. The outer shell is provided with a heating jacket using thermal heat transfer oil. The hydraulic head assembly, including shaft, impeller and motor, is flange connected to the shell and completely removable for ease of servicing. This configuration, with a high internal circulation rate, provides a highly effective dispersion of modifiers and reactants throughout the entire vessel volume and results in highly uniform composition and temperature. In order to apply its use to modified asphalts, one or more of the following modifications may be made:

1. In lieu of the welded top elliptical head, a flat flanged top can be provided to lower overall height and provide access to remove internals.
2. An additional large opening can be provided at the top to allow introduction of dry ingredients/modifiers.
3. A nozzle can be provided on the top for a level sensor to safeguard against high liquid levels and risk of overflow through top openings.
4. The heating jacket on the internal circulation tube can be eliminated along with the associated inlet and outlet heating fluid piping to facilitate circulation tube removal and reduce internal obstructions.
5. The circulation tube mounting can be modified to allow its complete removal for cleaning and servicing, as well as providing complete access to the internal shell surfaces.
6. Leaf springs can be provided at the top of the circulation tube to ensure that it is held down in opposition to the lifting force of the product flow.

7. The grating above the impeller can be eliminated to reduce its susceptibility to "plugging".
8. The size of the annulus between the circulation tube and shell can be increased to facilitate the flow of the higher viscosity fluids.
9. An overflow nozzle can be provided above the top of the circulation tube, which is at the top of the liquid level. This is a safeguard against overflowing the product at the top openings.
10. A nozzle can be provided for product discharge below the top of the circulation tube for continuous flow operation.
11. The lower discharge nozzle at the hydraulic head assembly can be used as a vessel drain.
12. Nozzles may be installed in the top in addition to the asphalt cement inlet and level sensor depending upon specific applications.

In an exemplary embodiment, and as further described in the attached drawings, the exemplary rubber modified asphalt system and process generally includes asphalt cement reacted with crumb rubber to produce a paving material that significantly outperforms conventional asphalt pavement. The system and process of the present invention is differentiated from these existing systems in several key aspects including for example:

1. It utilizes the heat-jacketed Modified Asphalt Contactor reactor ("MAC" reactor—also sometimes known as a "ECOPATH Contactor™ reactor" or "Contactor™ reactor"), which serves as a blender for the crumb rubber and asphalt cement as well as the reaction vessel for reacting the rubber particles with the asphalt cement and does not necessarily need a separate reaction tank.
2. The ECOPATH™ Blending System operates in a continuous mode, whereas existing systems operate in a batch mode.
3. By virtue of the highly effective MAC reactor, the finished product (asphalt rubber binder) can exhibit significantly better physical properties than is possible with existing blending systems.
4. By virtue of its highly effective blending reactor, the physical size of the ECOPATH™ Blending System can be significantly smaller than existing systems, allowing it to be mote easily transportable. For example, the ECOPATH™ Blending System can be fitted to a single standard trailer such that the production achieved is the same as current dual trailer systems.
5. The MAC reactor is highly effective at dispersing solid particles, including but not limited to crumb rubber, calcium carbonate, polymers, gilsonite, etc., within an asphalt cement base liquid.
6. The MAC reactor is highly effective at dispersing liquids, which may or may not chemically or physically change, within an asphalt cement base liquid, and the MAC reactor can be used as both a blending device and a heating device applicable to all mixtures of asphalt cement slurries, asphalt cement emulsions and other liquid modified asphalt solutions.
7. The MAC reactor is highly effective at heating mixtures, emulsions and slurries made from asphalt cement base liquid, using heated liquid circulated through its external heating jacket.
8. By virtue of its highly effective dispersion, the MAC reactor produces a highly uniform composition, which is very uniform in temperature.
9. By virtue of its highly efficient heat transfer, the MAC reactor can heat its contents with heating fluid at a lower temperature than less efficient, agitated vessels, which is safer and is less likely to cause thermal degradation of the asphalt cement base liquid.

10. By virtue of its highly efficient heat transfer, the MAC reactor can reduce energy costs related to heating via less efficient means upstream and downstream of the MAC reactor.
11. By virtue of its highly effective dispersion and its high volume to throughput ratio, the MAC reactor is highly resistant to clogging when handling heavy slurries, thereby reducing or eliminating undesirable system shutdowns.
12. By virtue of its removable internal circulation tube, the MAC reactor internal structures and surfaces can be more easily repaired or cleaned.
13. By virtue of the large curvature of its heating surface, the heating surface of the MAC reactor can be mote easily cleaned than small diameter heating tubes.
14. By virtue of its unique internal recirculation path, the heating surface is submerged and not exposed to air, avoiding the deposits related to coking.
15. By virtue of its well-designed lower assembly, the MAC reactor can be quickly, safely and completely drained in the event of an emergency, such as a power outage or system shutdown.
16. By virtue of its unique internal circulation and high fluid velocity across the heating surface, the MAC reactor very effectively prevents buildup of solid particles, which could inhibit heat transfer.
17. By virtue of its highly effective dispersion and heating, the MAC reactor can accelerate physical and chemical reactions between modifiers and asphalt cement, thereby reducing reaction time and heating requirements.
18. By virtue of its highly effective dispersion and heating, the MAC reactor can achieve greater performance characteristics than alternative, less efficient mixing vessels.
19. By virtue of the unique combination of components described as the modified asphalt blending system, the ECOPATH Blending system can produce acceptable asphalt rubber binder in a continuous mode, eliminating the need of an agitated storage tank or a prolonged reaction holding time.
20. By virtue of its compact size, being completely contained on a single standard size trailer, the ECOPATH Blending System can be mobilized to hot mix asphalt plants that heretofore could not accommodate the physical size of blending systems currently in use.
21. By virtue of its compact size, the ECOPATH Blending system requires less energy to maintain necessary product temperature during periods of non-use.
22. virtue of its compact size, being completely contained on a single standard size trailer, the ECOPATH Blending System has a lower mobilization and set-up costs, which allows smaller paving projects to become much more economically feasible.
23. By virtue of the flexibility of its continuous mode of operation, the ECOPATH Blending System described is suitable for hot mix asphalt plants of all sizes, within or outside the United States.
24. By virtue of a dual compartmented hopper and dual feed conveyors, the ECOPATH Blending System could produce "hybrid" rubber and polymer modified asphalt binders providing further unique properties not achievable by either modifier alone.

The following exemplary system and process generally includes a trailer mounted processing unit that can be moved to a hot mix asphalt plant and set up with a minimum of difficulty. (The hot mix asphalt plant encompasses the equipment to mix the asphaltic binder with rock aggregate to produce the finished asphalt used in paving).

In one exemplary embodiment, the ECOPATH Blending System includes the following component equipment:

1. Modified Asphalt Contactor (ECOPATH™ Contactor™) reactor
2. Mechanical Lubricator
3. Asphalt Cement Pump
4. Asphalt Cement Flow Meter
5. Crumb Rubber Hopper/Feeder
6. Crumb Rubber Conveyor
7. Asphalt Cement Preheater
8. Thermal Oil Heating System
9. Fuel Delivery System
10. Asphalt Rubber Binder Pump
11. Asphalt Rubber Flow Meter
12. Control System
13. Trailer Alternatively, this System could be provided in a stationary configuration, being permanently installed at one location with the finished asphalt rubber binder transported to a hot mix asphalt plant by tank truck. The system can also be used for polymer modified asphalt binders.

The novel features that are considered characteristic of the invention are set forth with particularity in the appended claim. The invention itself, however, both as to its structure and its operation together with the additional object and advantages thereof can best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of the Preferred Embodiments is not intended to indicate a desire to invoke the special provision of 35 U.S.C. §112, paragraph 6 to define the invention. To the contrary, if the provisions of 35 U.S.C. §112, paragraph 6 are sought to be invoked to define the invention(s), the claims will specifically state the phrases "means for" or "step for" and a function, without also reciting in such phrases any structure, material, or act in support of the function.

Moreover, even if the provisions of 35 U.S.C. §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 1:
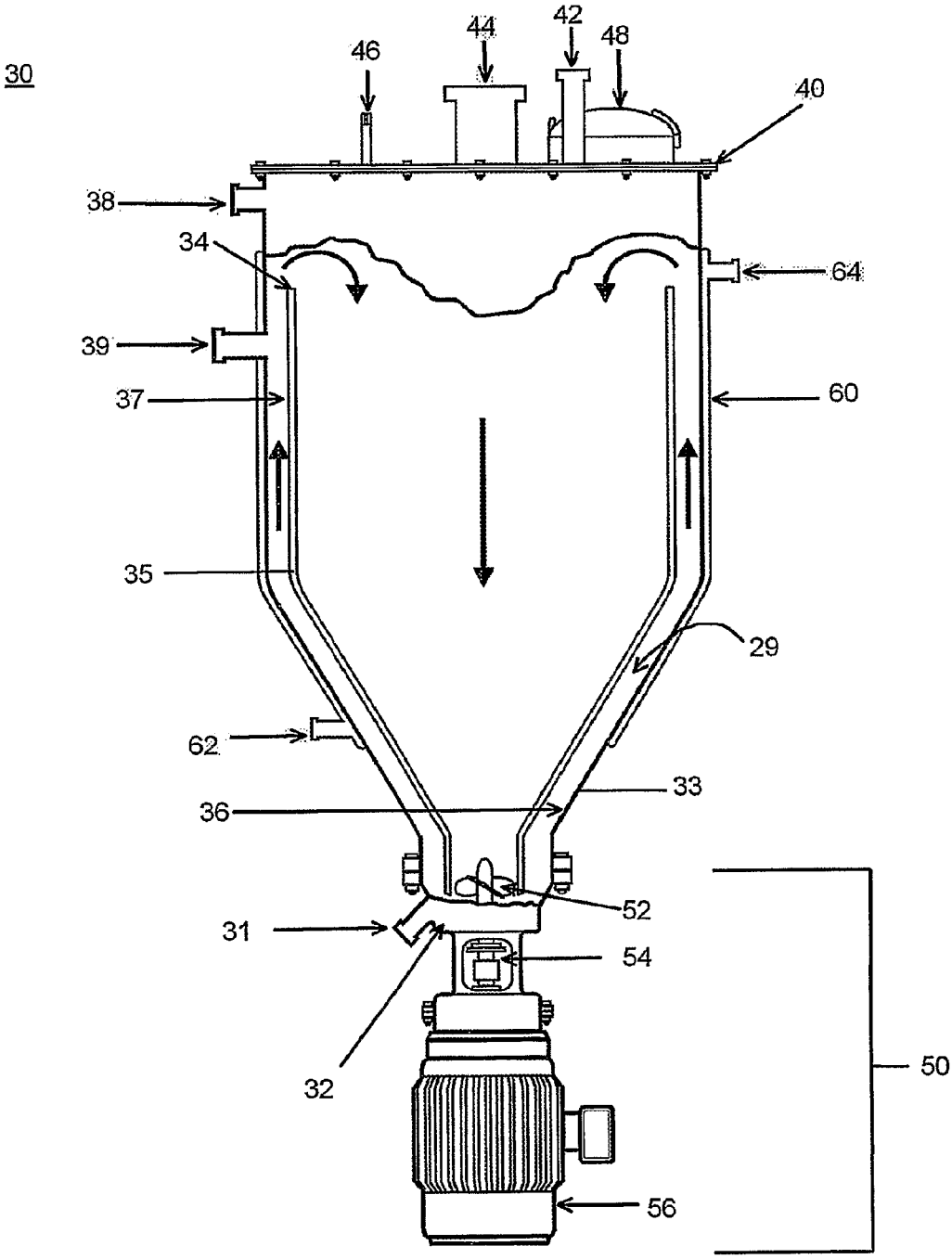
FIG. 1 depicts a cross-sectional view of a preferred embodiment of an asphalt Contactor reactor.
Figure 2:
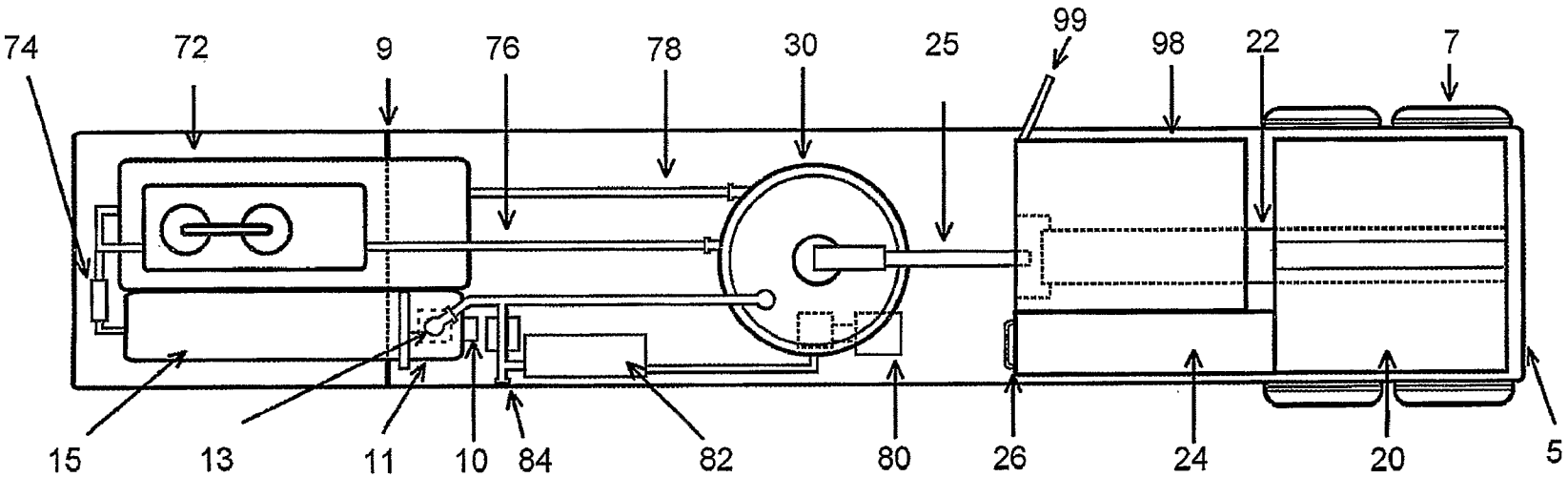
FIG. 2 depicts a preferred embodiment of an ECOPATH™ Blending System.
Figure 3:
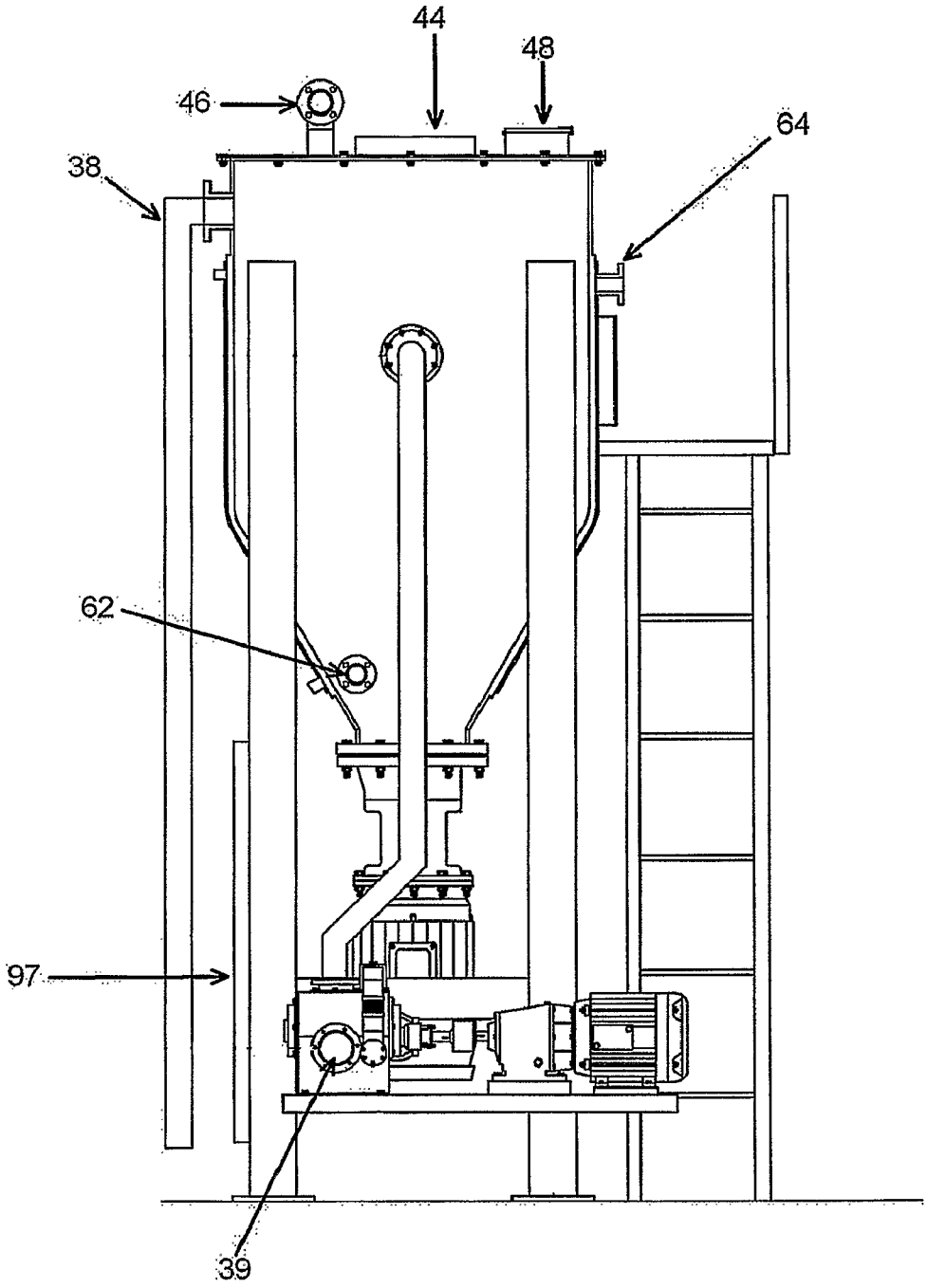
FIG. 3 depicts a preferred embodiment of an asphalt Contactor reactor.

The following is an exemplary description of the major process streams and equipment for the ECOPATH™ Blending System are shown in FIGS. 1, 2 and 3. FIG. 2 specifically shows a preferred embodiment of the invention coupled to a single standard trailer 5 having tires 7 and a trailer step up 9 in the front where the under portion (not shown) of the trailer 5 may couple with a semi-tractor (not shown).

Raw Asphalt Cement Delivery: Standard tank trucks can deliver raw asphalt cement to the location of the Blending System. The temperature of the delivered asphalt is typically between about 250° F.-300° F. The typical storage volume of a delivery truck is about 5000 to 6000 gallons. A gear type positive displacement pump (also known as a Asphalt Cement Pump) 10 included in the Blending System can be connected to the discharge connection of the tank truck with a flexible high temperature hose (also furnished with the Blending System) and can transfer the asphalt cement to the System. The flow rate of the asphalt cement can be determined by the binder flow rate required by the hot mix asphalt plant when the system operates in conjunction with this plant. When the system is operated independently, in an exemplary embodiment, the asphalt cement flow rate can be adjustable to a maximum of about 95,000 pounds per hour. The flow rate can be measured by an in-line turbine type mass flowmeter 13 (also known as an Asphalt Cement Flow Meter) and can be controlled via a variable speed motor controller serving the Asphalt Cement Pump 10 through an Asphalt Cement Inlet 11.

Crumb Rubber Delivery: Crumb rubber, generally ground car and truck tires, is delivered to the location of the Blending System in about 2000 lb supersacks. The sacks are provided with top mounted loops for forklift handling. A forklift can be used to position the sacks over a crumb rubber feed hopper 20 (also know as a "feed hopper" or a "Solid Modified Hopper"), into which the crumb rubber can be dispensed. The feed hopper 20 having a service catwalk 24 and ladder 26 can be equipped with a screw feeder, which can feed the crumb rubber to a conveyor 22 (also known as a "Solid Modified Conveyor") equipped with a weighbridge. The weighbridge conveyor can meter the crumb rubber into a secondary hopper. The feed rate can be determined by a control system to control the mass ratio of crumb rubber to asphalt cement, with the ratio being programmable from approximately 2% to 75% by weight. The crumb rubber can be transferred from the secondary hopper to the Contactor™ reactor via an auger assembly 25 (also sometimes known as a "Solid Modified lift Auger").

Asphalt Cement Preheater: The Asphalt Cement Pump 10 can circulate the asphalt cement through the Asphalt Cement Preheater 15, sized to elevate the temperature of the asphalt cement to a preset temperature between about 375° F. and 425° F. The Asphalt Cement Preheater shall be heated via thermal heat transfer fluid.

Modified Asphalt Contactor ECOPATH™ Contactor™) Reactor: The Modified Asphalt Contactor (ECOPATH™ Contactor™) reactor 30 combines the capabilities of highly effective blending with efficient heat transfer and temperature control to provide a unique reactor. One aspect of the invention comprises a reactor design as a vessel that is vertically oriented with a bottom-mounted axial flow impeller 52. The vessel is equipped with an internal cylindrical circulation tube 35 with the impeller 52 located at the lower end 32 (also called a hydraulic head). The impeller 52 pulls the vessel contents downward through the cote of the internal circulation tube 35, discharging into the hydraulic head 32, which is designed to smoothly channel the flow upward through the annulus 29 between the internal surface 36 of the vessel outer shell 33 and the outside surface 37 of the internal circulation tube 35. The flow travels upward and over the top 34 of the internal circulation tube 35, returning downward into the core to complete its circuit. The outer shell 33 is provided with a heating jacket 60 using thermal heat transfer oil. The hydraulic head assembly 50, including shaft and coupling 54, impeller 52 and motor 56, is flange connected to the shell. The reactor 30 is distinguishable by an internal circulation tube 35 at the base of which is a high-speed impeller 52, which may be equipped with a variable speed controller for controlling the internal recirculation rate. The internal circulation tube 35 is completely removable from the reactor so that it can be easily cleaned and serviced, as well as providing complete access to the internal shell surfaces of the reactor. In order to facilitate the easy removal of the internal circulation tube from the reactor, there is no heating jacket on the internal circulation tube and the associated inlet and outlet heating fluid piping is eliminated. Leaf springs or brackets (internal circulation tube holders) may be provided at the top of the circulation tube to ensure that it is held in place in opposition to the lifting force of the product flow through the reactor. An overflow nozzle 38 is located above the top 34 of the circulation tube, which is at the top of the liquid level. This overflow nozzle 38 is a safeguard against overflowing of the product at the top openings of the reactor. In addition to the overflow nozzle, another nozzle 39 (also sometimes known as a Modified Asphalt Supply Outlet) is located below the top 34 of the circulation tube for product discharge to facilitate continuous flow operation of the reactor 30. The discharged modified asphalt may preferably be pumped using a modified asphalt pump 80 to a modified asphalt outlet 84 and also preferably measured using a modified asphalt flow meter 82.

The high-speed impeller draws the fluid mixture within the circulation tube downward, discharging into a contoured head assembly, which redirects the contents upward through the annulus 29 between the internal circulation tube 35 and outer shell 33. In order to eliminate possible "plugging" of the mixture, there is no grating above the high-speed impeller. The mixture exits the annulus at the top of the circulation tube, flowing back down through the circulation tube to the impeller. The annulus 29 is a sufficient size to facilitate the flow of high viscosity fluids.

The external shell (also known as the external surface of the outer shell) is jacketed 60 for circulation of thermal heating oil. This configuration provides a substantial heat transfer surface area and the high velocity of product across the surfaces enhances the rate of heat transfer. Also, by circulating the mixture at a high rate through the impeller 52, the contents are thoroughly mixed, providing homogeneity in both temperature and composition. The reactor 30 is sized to provide the necessary residence time for the reactants and is anticipated to have a working volume between about 300 and 500 US gallons.

The reactor includes a flat, flanged top 40 that reduces the overall height of the reactor described in the present invention as compared to a conventional welded top elliptical head reactor. The flat flanged top 40 also provides easy access to remove the internal circulation tube 35. Along the flat-flanged top 40 of the reactor 30 is an additional large opening 44 (also known as a solid modifier inlet) that allows introduction of the dry ingredients/modifiers to the reactor. In addition to the large opening for the dry ingredients/modifiers, a nozzle is in place on the flat flanged top 40 of the reactor 30 for a level sensor 46 to safeguard against high liquid levels and the risk of overflow through the top openings. In alternate embodiments, nozzles may be installed in the top in addition to the asphalt cement inlet 42 and level sensor depending upon specific applications. At the bottom of the reactor is a lower discharge nozzle 31 (also known as a drain outlet) at the hydraulic head assembly that is used as a vessel drain. The flat, flanged top 40 may also have a service manway 48.

In an exemplary embodiment, the asphalt cement is transferred to the reactor 30 from the Asphalt Cement Preheater 15 while the crumb rubber is introduced through the additional large opening 44 on the flat flanged top 40 of the reactor 30. The heating is controlled to maintain a preset product temperature between about 375° F. and 400° F., which is monitored at a thermowell located in the lower head assembly 32 (also called the lower end or hydraulic head). The reactor 30 can be equipped with a motor driven force feed lubricator for lubrication of the bearing and mechanical seal.

Thermal Oil Heating System: The Thermal Oil Heating System can be provided to supply heat transfer fluid for heating the reactor 30 and the Asphalt Cement Preheater 15. The Heating System includes, in one embodiment, a direct-fired heater 72 (also known as a Thermal Oil Heater), circulating pump 74 (also known as a Thermal Oil Pump), fluid strainer, air separator, expansion/drain tank, and necessary controls. The heater may utilize one of the following alternative fuels: fuel oil, natural gas or LP gas. The System can be designed to supply thermal heating oil through a Hot Oil Pipe 76 for the Blending System at a preset temperature between about 450° F. and 600° F. and returned through a Hot Oil Return 78. The Thermal Oil Heating System can be energized by the Control System 90, powering the heater and the circulating pump. The control system furnished with the heater can be programmed to regulate the supply temperature to a preset value via burner rate control.

Finished Product Delivery: The finished asphalt rubber can be transferred from the reactor to either the mixing equipment at the hot mix asphalt plant or a storage tank or a tank truck for transport. Transfer is provided via a specially designed gear type positive displacement pump. The flow rate can be measured by an inline Coriolis type mass flow meter 82 and can be controlled via a variable speed motor controller serving the Asphalt Rubber Pump 80 (also known as a Modified Asphalt Pump). Finished product properties can vary according to application and specifications of the governing authority. Exemplary properties are as follows:

1. Brookfield Viscosity, 350° F. (Modified ASTM D 2669): 1500 cP (min); 5000 cP (max)
2. Penetration, 77° F., 100 g, 5 sec (ASTM D5): 2.5 mm (min); 10 mm (max)
3. Softening Point (ASTM D 36): 125° F. (min)
4. Resilience, 77° F. (ASTM 3407 or ASTM 5329): 20% (min)

System Controls: The Blending System is designed, in one embodiment, to operate in a continuous mode. A Control System can be programmed to maintain a preset mass ratio between the crumb rubber and asphalt cement delivered to the reactor. For systems operated in conjunction with a hot mix asphalt plant, the required flow rate of the finished product can be determined by the binder flow rate established by the asphalt mixing equipment, which can be communicated to the Control System via a proportional control signal. The Control System can use this signal in conjunction with the preprogrammed binder rubber content to signal the proper flow control for the crumb rubber and asphalt cement. The Control System is preferably placed in a control panel 97 and preferably placed in a control house 98 having a door 99

Crumb Rubber Feed: The crumb rubber feeder control system can monitor and control the flow rate of crumb rubber in response to signals from the Control System. The crumb rubber feeder control system shall measure the flow rate directly by mass via signals from load cells, strain gauges or displacement gauges. The crumb rubber feed rate can be controlled via a variable speed drive serving the feed auger and/or conveyor belt 22. The lift conveyor 25 can operate at constant speed, delivering crumb rubber at the rate being delivered by the Crumb Rubber Conveyor Belt 22. Alternatively, this conveyor may be controlled via a variable speed drive in tandem with the Feeder.

Asphalt Cement Feed: The asphalt cement flow rate can be controlled in response to the required mass flow rate and the flow measurement signal from the asphalt cement flow meter 13. Flow rate can be adjusted via a variable speed drive serving the Asphalt Cement Pump 10.

Asphalt Cement Preheater: The Asphalt Cement Preheater 15 can be controlled to raise the temperature of the asphalt cement to a preset discharge temperature by the Control System. The Control System can transmit a signal to vary the flow rate via a thermal oil control valve for an oil heated preheater or, alternatively, can vary the preset discharge thermal oil temperature supplied to the preheater.

Modified Asphalt Contactor Reactor: The reactor is controlled to maintain product temperature and internal circulation. The product temperature is controlled to maintain a preset temperature by the Control System. Temperature is measured by a temperature sensor in a thermowell located in the lower head assembly 32. The product temperature is regulated via a signal controlling the preheater as described above. The internal circulation rate is regulated by a control signal to a variable speed drive serving the impeller drive motor 56. Alternatively, this motor may be set at a constant speed without a variable speed controller.

Asphalt Rubber Feed: The asphalt rubber flow rate can be controlled in response to the required mass flow rate of the hot mix asphalt plant and the flow measurement signal from the asphalt rubber flow meter 82. Flow rate can be adjusted via a variable speed drive serving the Asphalt Rubber Pump 80.

The preferred embodiment of the invention is described above, in the Drawings, and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be give the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A modified asphalt Contactor reactor for blending and reacting asphalt cement and modifiers comprising: a vertically oriented vessel having an outer shell having an internal surface and an external surface, a lower end and a flat flanged top; a removable internal circulation tube having a base, a top and an outside surface, wherein the outside surface of the internal circulation tube and the internal surface of the outer shell forms an annulus; at least two leaf springs or brackets coupled to the top of the internal circulation tube to hold the internal circulation tube in place; an overflow nozzle above the circulation tube; a nozzle below the top of the circulation tube for continuous flow operation; a heating jacket having heating oil inlet and a heating oil outlet coupled to the external surface of the outer shell for circulation of heating oil; and a hydraulic head assembly having an impeller coupled to the lower end of the vertically oriented vessel wherein the impeller is located near the base of the internal circulation tube, wherein the impeller and the annulus are of sufficient size to facilitate the flow of high viscosity fluids.

2. The modified asphalt Contactor reactor of claim 1, wherein the internal flat flanged top further comprises a solid modifier inlet for dry ingredients or modifiers.

3. The modified asphalt Contactor reactor of claim 2, wherein the internal flat flanged top further comprises a level sensor.

4. The modified asphalt Contactor reactor of claim 1, further comprising a drain outlet located near the lower end.

5. The modified asphalt Contactor reactor of claim 4, wherein the volume of the vessel is between 300 and 500 US gallons.

6. The modified asphalt Contactor reactor of claim 5, wherein the modified asphalt Contactor reactor may be coupled to a single standard trailer for transport.

7. The modified asphalt Contactor reactor of claim 6, wherein the single standard trailer further comprises a thermal oil system coupled to the modified asphalt Contactor reactor.

8. The modified asphalt Contactor reactor of claim 7, wherein the single standard trailer further comprises an asphalt cement inlet coupled to an asphalt cement flow meter coupled to an asphalt cement preheater coupled to modified asphalt Contactor reactor.

9. The modified asphalt Contactor reactor of claim 8, wherein the single standard trailer further comprises a solid modifier hopper coupled to a solid modifier conveyor coupled to a solid modifier lift auger coupled to the solid modifier inlet.

10. The modified asphalt Contactor reactor of claim 9, wherein the solid modifier hopper may be a dual compartmented hopper and wherein the solid modifier conveyor is a dual fee conveyor.

11. The modified asphalt Contactor reactor of claim 10, wherein the single standard trailer further comprises a control house.

* * * * *